US010941781B2

(12) United States Patent
Wegener

(10) Patent No.: US 10,941,781 B2
(45) Date of Patent: Mar. 9, 2021

(54) ELECTRIC MOTOR VEHICLE AXIAL-FLOW LIQUID PUMP

(71) Applicant: PIERBURG PUMP TECHNOLOGY GMBH, Neuss (DE)

(72) Inventor: Robin Wegener, Leverkusen (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 159 days.

(21) Appl. No.: 15/774,283

(22) PCT Filed: Nov. 10, 2015

(86) PCT No.: PCT/EP2015/076243
§ 371 (c)(1),
(2) Date: May 8, 2018

(87) PCT Pub. No.: WO2017/080591
PCT Pub. Date: May 18, 2017

(65) Prior Publication Data

US 2018/0313354 A1 Nov. 1, 2018

(51) Int. Cl.
*F04D 13/06* (2006.01)
*F04D 3/00* (2006.01)
(Continued)

(52) U.S. Cl.
CPC ..... *F04D 13/0626* (2013.01); *F04D 3/00* (2013.01); *F04D 13/064* (2013.01); *F04D 29/181* (2013.01); *F04D 29/528* (2013.01)

(58) Field of Classification Search
CPC ..... F04D 13/064; F04D 13/0646; F04D 29/0476; F04D 3/00; F04D 3/02;
(Continued)

(56) References Cited

U.S. PATENT DOCUMENTS 4,185,215 A * 1/1980 Montagu ..... H02K 7/116 310/156.38
4,948,999 A * 8/1990 Bertram ..... B29C 45/0013 310/156.43
(Continued)

FOREIGN PATENT DOCUMENTS

CA 2145857 C 4/1999
DE 202 02 027 U1 4/2002
(Continued)

OTHER PUBLICATIONS

Wikipedia: "Bürstenloser Gleichstrommotor", https://de.wikipedia.org/wiki/B%C3%BCrstenloser Gleichstrommotor, pp. 1-4 (retrieved Jul. 1, 2016), English Translation.

*Primary Examiner* — Dominick L Plakkoottam
(74) *Attorney, Agent, or Firm* — Norman B. Thot

(57) ABSTRACT

An electric motor vehicle-axial-flow liquid pump which is designed as an internal rotor pump. The electric motor vehicle-axial-flow liquid pump includes a pump housing with an axial inlet opening for admitting a liquid and an axial outlet opening for discharging the liquid, and an electric motor arranged in the pump housing. The electric motor includes a motor stator with at least one external stator coil, a can formed radially inside the at least one external stator coil, and a rotor body which is permanently magnetized and which is provided as an axial-flow impeller rotatably arranged inside the can. The rotor body has an axis of rotation and at least one blade which pumps the liquid from the inlet opening to the outlet opening along the axis of rotation.

7 Claims, 1 Drawing Sheet

(51) Int. Cl.
*F04D 29/52* (2006.01)
*F04D 29/18* (2006.01)

(58) Field of Classification Search
CPC .. F04D 13/06; F04D 13/0606; F04D 13/0626; F04D 29/181
See application file for complete search history.

(56) References Cited

U.S. PATENT DOCUMENTS

| | | | | |
|---|---|---|---|---|
| 9,956,332 | B2 * | 5/2018 | LaRose | A61M 1/101 |
| 2004/0234391 | A1 | 11/2004 | Izraelev | |
| 2004/0241019 | A1 * | 12/2004 | Goldowsky | A61M 1/1015 417/423.1 |
| 2004/0265153 | A1 * | 12/2004 | Torrey | F04C 2/18 417/423.7 |
| 2006/0045776 | A1 * | 3/2006 | Kalavsky | F04D 13/0646 417/423.14 |
| 2007/0100196 | A1 * | 5/2007 | LaRose | A61M 1/101 600/16 |
| 2015/0300356 | A1 * | 10/2015 | Malvasi | F04D 13/06 417/423.7 |

FOREIGN PATENT DOCUMENTS

| | | | |
|---|---|---|---|
| DE | 102 51 461 | A1 | 5/2004 |
| DE | 20 2012 010 653 | U1 | 11/2012 |
| EP | 2 730 785 | A1 | 5/2014 |
| GB | 2 042 279 | A | 9/1980 |
| JP | H08-504490 | A | 5/1996 |
| JP | 2002-138986 | A | 5/2002 |
| JP | 2008-199801 | A | 8/2008 |
| JP | 2009-270512 | A | 11/2009 |

* cited by examiner

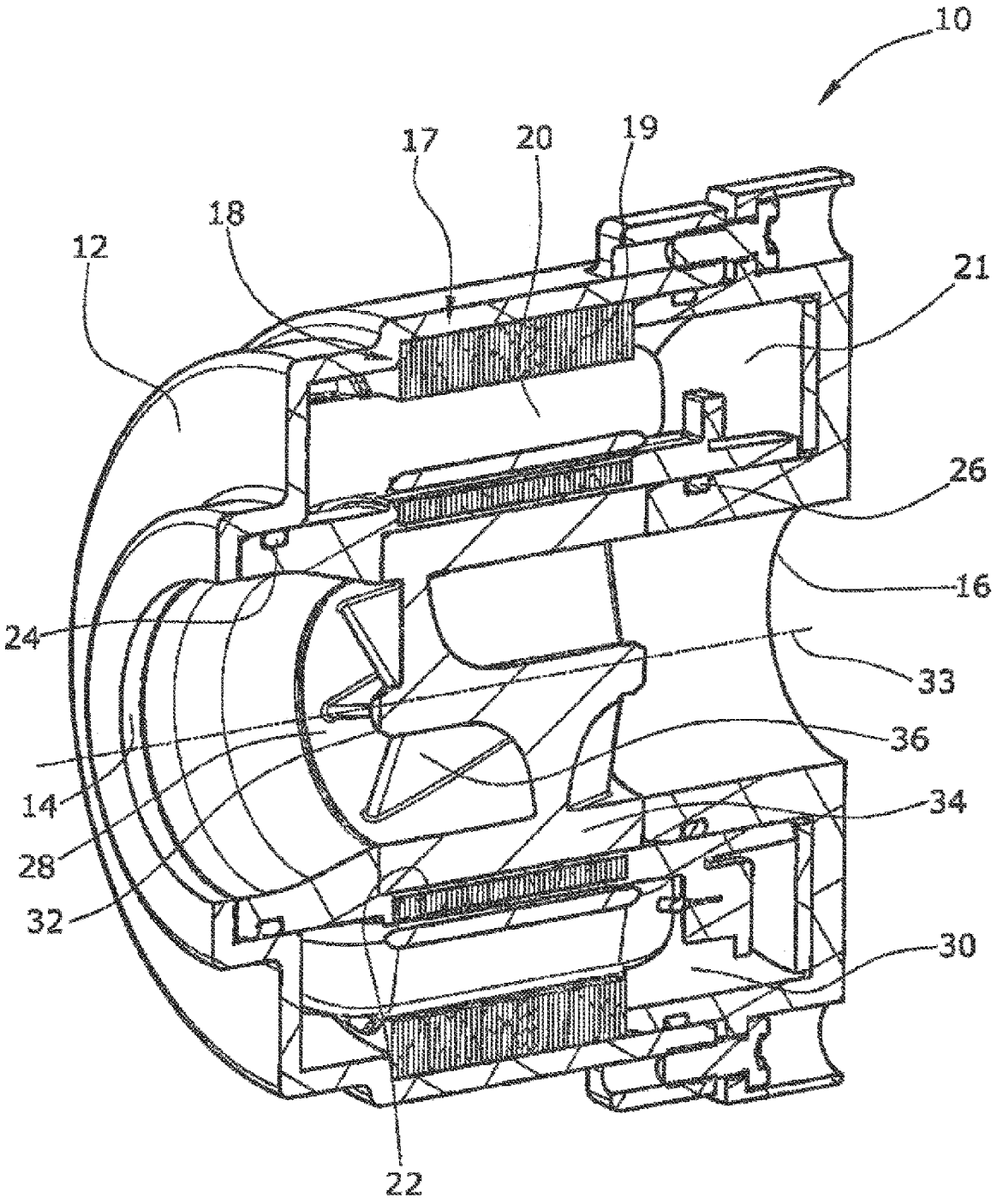
10
17
20
19
18
12
21
26
16
24
33
36
14
34
28
32
30
22

ELECTRIC MOTOR VEHICLE AXIAL-FLOW LIQUID PUMP

CROSS REFERENCE TO PRIOR APPLICATIONS

This application is a U.S. National Phase application under 35 U.S.C. § 371 of International Application No. PCT/EP2015/076243, filed on Nov. 10, 2015. The International Application was published in German on May 18, 2017 as WO 2017/080591 A1 under PCT Article 21(2).

FIELD

The present invention relates to an electric motor vehicle axial-flow liquid pump which is designed as an internal rotor pump.

BACKGROUND

The electric motor vehicle axial-flow liquid pump comprises a pump housing which forms an axial inlet opening and an axial outlet opening for admitting and discharging the liquid, and an electric motor which drives an impeller.

Various electric motor vehicle axial-flow liquid pumps have previously been described in the prior art where an electric motor drives the impeller via a shaft.

SUMMARY

An aspect of the present invention is to provide an electric motor vehicle axial-flow liquid pump which has a simpler configuration and is thus easier to manufacture.

In an embodiment, the present invention provides an electric motor vehicle-axial-flow liquid pump which is designed as an internal rotor pump. The electric motor vehicle-axial-flow liquid pump includes a pump housing comprising an axial inlet opening for admitting a liquid and an axial outlet opening for discharging the liquid, and an electric motor arranged in the pump housing. The electric motor comprises a motor stator comprising at least one external stator coil, a can formed radially inside the at least one external stator coil, and a rotor body which is configured to be permanently magnetized and which is provided as an axial-flow impeller rotatably arranged inside the can. The rotor body comprises an axis of rotation and at least one blade which is configured to pump the liquid from the inlet opening to the outlet opening along the axis of rotation.

BRIEF DESCRIPTION OF THE DRAWING

The present invention is described in greater detail below on the basis of embodiments and of the drawing in which:

FIG. 1 shows a perspective longitudinal section of an electric motor vehicle axial-flow liquid pump according to the present invention.

DETAILED DESCRIPTION

The electric motor vehicle axial-flow liquid pump of the present invention has an electric motor which comprises a can which is arranged radially inside the at least one stator coil. The can separates a working chamber, in which the liquid to be delivered is located, from an electronics chamber. The can may be part of a pump housing. Inside the can, a rotor body is rotatably arranged which includes at least one blade and which delivers the liquid from an inlet opening of the electric motor vehicle axial-flow liquid pump to an outlet opening. The rotor body has a permanently magnetic design. The rotor body thus unites rotor and impeller to form an integral component. Due to the configuration of the present invention, further components, such as a shaft for driving a separate impeller, are omitted. The electric motor vehicle axial-flow liquid pump can thus be manufactured in a more rapid, easier, and thus more economic manner.

In an embodiment of the present invention, the motor stator can, for example, comprise a plurality of external stator coils.

In an embodiment of the present invention, the rotor body can, for example, be formed integrally.

In an embodiment of the present invention, the motor stator including the stator coils can, for example, be at least partially embedded in a plastic injection-molded body which forms the can. The can is thereby configured radially inside the stator coils. A can provided as a separate component can thus be omitted, and the manufacture of the electric motor vehicle axial-flow liquid pump is faster and easier.

In an embodiment of the present invention, the rotor body and the can can, for example, together form a slide bearing. A slide bearing within the meaning of the present invention is to be understood as the arrangement of the rotor body and the can with a liquid-filled slit between the outer circumferential surface of the rotor body and the inner circumferential surface of the can. No additional components are thus required for rotatably supporting the rotor body. Further components can therefore be omitted, and the electric motor vehicle axial-flow liquid pump can be manufactured in a more rapid and economic manner.

In an embodiment of the present invention, the slide bearing can, for example, be configured cylindrically and step-free over the overall axial length of the rotor body. Such a slide bearing is advantageous because it is easy to manufacture. Installation of such a slide bearing is also facilitated.

In an embodiment of the present invention, the rotor body can, for example, include plastic-bonded permanently magnetic particles. These permanently magnetic particles can, for example, be neodymium particles and/or ferrite particles. Such rotor bodies can be manufactured in a particularly inexpensive manner so that the cost effectiveness of a corresponding electric motor vehicle axial-flow liquid pump can be increased. Such a rotor body also has a smaller mass moment of inertia than a full-metal rotor so that the efficiency of the electric motor vehicle axial-flow liquid pump is improved.

The rotor body can alternatively be made of a plastic material in which rotor sheets with permanent magnets are embedded. A rotor body manufactured in this way offers the advantage that it is manufactured in a conventional manner and is thus inexpensive.

In an embodiment of the present invention, the rotor can, for example, be configured so that it comprises a plurality of blades, for example, seven blades. The number of blades can thus be selected depending on the required hydraulic power of the pump.

Further details and advantages of the present invention are apparent from the following description of the exemplary embodiment in conjunction with the drawing.

FIG. 1 shows an electric motor vehicle axial-flow liquid pump 10 according to the present invention whose drive motor is designed as an internal rotor pump. The electric motor vehicle axial-flow liquid pump 10 comprises a bipartite pump housing 12 having an axial inlet opening 14 for admitting liquid into the electric motor vehicle axial-flow liquid pump 10. An axial outlet opening 16 for discharging liquid from the electric motor vehicle axial-flow liquid pump 10 is provided at a longitudinal end of the pump housing 12 axially opposite to the inlet opening 14.

The electric motor vehicle axial-flow liquid pump 10 further comprises an electric motor 17 as a drive motor which is provided in the pump housing 12. The electric motor 17 comprises a radially external motor stator 18 located inside the pump housing 12. The motor stator 18 comprises a reflux body 19 and stator coils 20. Current feed to the stator coils 20 is controlled by a radially external electronics unit 21 provided at the outlet-side end.

Radially inside the stator coils 20, the reflux body 19 of the motor stator 18 is embedded in a plastic injection-molded body so that the plastic injection-molded body forms a can 22. The can 22 sealingly rests against the pump housing 12 via an inlet-side ring seal 24 and an outlet-side ring seal 26 and fluidically separates a working chamber 28, in which the liquid to be delivered is located, from an electronics chamber 30. Inside the can 22, a rotor body 32 configured as an axial-flow impeller of the electric motor 17 is arranged which delivers the liquid from the inlet opening 14 to the outlet opening 16 along an axis of rotation 33 of the rotor body 32. The rotor body 32 is composed of a hollow cylinder 34, with seven blades 36 being provided inside the hollow cylinder 34 extending in an axial direction.

The present invention is not limited to embodiments described herein; reference should be had to the appended claims.

LIST OF REFERENCE NUMERALS

10 Electric motor vehicle axial-flow liquid pump
12 Pump housing
14 Axial inlet opening
16 Axial outlet opening
17 Electric motor
18 Motor stator
19 Reflux body
20 Stator coils
21 Electronics unit
22 Can
24 Inlet-side ring seal
26 Outlet-side ring seal
28 Working chamber
30 Electronics chamber
32 Rotor body
33 Axis of rotation
34 Hollow cylinder
36 Blade

What is claimed is:

1. An electric motor vehicle-axial-flow liquid pump designed as an internal rotor pump, the electric motor vehicle-axial-flow liquid pump comprising:

a pump housing comprising an axial inlet opening for admitting a liquid and an axial outlet opening for discharging the liquid; and an electric motor arranged in the pump housing, the electric motor comprising, a motor stator comprising a plurality of external stator coils, a can formed radially inside the plurality of external stator coils, and an integrally-formed rotor body which is configured to be permanently magnetized and which is provided as an axial-flow impeller rotatably arranged inside the can, the integrally-formed rotor body comprising plastic-bonded permanent-magnet particles, an axis of rotation and at least one blade which is configured to pump the liquid from the inlet opening to the outlet opening along the axis of rotation, wherein, the integrally-formed rotor body and the can together form a slide bearing, and the slide bearing provides a rotatable support for the integrally-formed rotor body.

2. The electric motor vehicle axial-flow liquid pump as recited in claim 1, wherein the rotatable support of the integrally-formed rotor body is provided only by the slide bearing without additional components.

3. The electric motor vehicle axial-flow liquid pump as recited in claim 1, wherein the slide bearing is configured cylindrically and step-free over an overall axial length of the integrally-formed rotor body.

4. The electric motor vehicle axial-flow liquid pump as recited in claim 1, wherein, the can is formed as a plastic injection-molded body, and the motor stator is arranged to be at least partially embedded in the plastic injection-molded body.

5. The electric motor vehicle axial-flow liquid pump as recited in claim 1, wherein the plastic-bonded permanent-magnet particles are at least one of neodymium particles and ferrite particles.

6. The electric motor vehicle axial-flow liquid pump as recited in claim 1, wherein, the integrally-formed rotor body further comprises a plastic material, and the plastic-bonded permanent-magnet particles are arranged in rotor sheets which are embedded in the plastic material.

7. The electric motor vehicle axial-flow liquid pump as recited in claim 1, wherein the integrally-formed rotor body further comprises a plurality of blades.

* * * * *